US009364725B2

(12) United States Patent
Hettinger et al.

(10) Patent No.: US 9,364,725 B2
(45) Date of Patent: Jun. 14, 2016

(54) GOLF CLUB

(71) Applicant: Acushnet Company, Fairhaven, MA (US)

(72) Inventors: Ronald K. Hettinger, Carlsbad, CA (US); Keisuke Yamane, Guangzhou (CN); Hiroshi Kawaguchi, Carlsbad, CA (US); Richard L. Cleghorn, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 14/220,367

(22) Filed: Mar. 20, 2014

(65) Prior Publication Data

US 2015/0265885 A1 Sep. 24, 2015

(51) Int. Cl.

| | |
|---|---|
| ***A63B 53/06*** | (2015.01) |
| ***A63B 53/04*** | (2015.01) |
| *A63B 53/00* | (2015.01) |

(52) U.S. Cl.

CPC ..... *A63B 53/04* (2013.01); *A63B 2053/005* (2013.01); *A63B 2053/0408* (2013.01); *A63B 2053/0433* (2013.01); *A63B 2053/0491* (2013.01)

(58) Field of Classification Search

CPC ..... A63B 2053/005; A63B 53/04; A63B 2053/0408; A63B 2053/0433; A63B 2053/0491

See application file for complete search history.

(56) References Cited

U.S. PATENT DOCUMENTS

| | | | | | |
|---|---|---|---|---|---|
| 2,146,321 | A * | 2/1939 | Wettlaufer | ..... | 473/306 |
| 2,534,947 | A * | 12/1950 | Bright | ..... | 473/312 |
| 3,984,103 | A * | 10/1976 | Nix | ..... | 473/291 |
| 5,480,145 | A * | 1/1996 | Sherwood | ..... | 473/291 |
| 5,851,160 | A * | 12/1998 | Rugge et al. | ..... | 473/349 |
| 6,830,519 | B2 * | 12/2004 | Reed et al. | ..... | 473/290 |
| 7,530,900 | B2 * | 5/2009 | Holt et al. | ..... | 473/307 |
| 8,070,621 | B2 * | 12/2011 | Nakano | ..... | 473/290 |
| 8,998,742 | B2 * | 4/2015 | Ines et al. | ..... | 473/291 |
| 2002/0032071 | A1 * | 3/2002 | Gallagher | ..... | 473/256 |

* cited by examiner

*Primary Examiner* — Stephen Blau

(74) *Attorney, Agent, or Firm* — Smith, Gambrell & Russell, LLP

(57) ABSTRACT

The present invention concerns a set of golf club heads having progressive head sizing such that the size of the club heads in the set decreases as the loft angle of the club heads increases; and golf club sets including such club heads. The present invention also concerns weighting systems for use with the progressively sized club head set.

30 Claims, 13 Drawing Sheets

GOLF CLUB

FIELD OF THE INVENTION

The present invention relates to a set of progressively sized golf club heads that decrease in size as the loft angle increases, and golf club sets including such club heads. The present invention also relates to weighting systems for use with the progressively sized club heads.

BACKGROUND OF THE INVENTION

Conventional golf club sets typically include one or more metal-woods and one or more irons. Among the differences between metal-woods and irons is the construction of the club head. In particular, metal-woods are regularly constructed with a large bulbous head that is often hollow, and has a relatively vertical forward face. On the other hand, irons are regularly constructed with a plate-like shape that often has a slanted forward face. Metal-woods tend to provide a greater maximum driving potential due to their hollow construction and deformable face cup, whereas irons tend to provide a greater loft potential due to their slanted forward face.

In addition to metal-woods and irons, there is also a hybrid club (e.g., a utility club). A hybrid club is characterized by a club head that combines the bulbous and hollow construction of a metal-wood head with the slanted forward face of an iron head. As a result, hybrid club heads tend to provide both a longer maximum drive potential and a higher loft potential.

A drawback of hybrid clubs, however, is that the club heads are relatively large. In particular, because of the combination of a hollow body construction and a slanted forward face, hybrid club heads tend to sequentially increase in size as the loft angle of the club heads increases. Many players find the increasingly large heads of hybrids clubs unappealing. Unfortunately, simply decreasing the size of the hybrid club heads tends to result in significant changes to the performance of the club heads. In particular, decreasing the size of a hybrid club head will alter a number of performance characteristics such as the center of gravity, the moment of inertia (MOI), and the swingweighting.

Accordingly, there remains a need in the art for a set of hybrid golf club heads that have a more visually appealing sizing, while at the same time not sacrificing the performance characteristic of the club heads.

SUMMARY OF THE INVENTION

The present invention relates to a set of progressively sized golf club heads that decrease in size as the loft angle increases, and golf club sets including such club heads. The present invention also relates to weighting systems for use with club heads.

In a first aspect of the present invention, there is a set of golf clubs including: a first golf club having a first club head with a first loft angle, a first lie angle, and a first face height; a second golf club having a second club head with a second loft angle, a second lie angle, and a second face height; and a third golf club having a third club head with a third loft angle, a third lie angle, and a third face height.

The third face height may be less than the second face height, and the second face height may be less than the first face height.

The first loft angle may be less than the second loft angle, and the third loft angle may be greater than the second loft angle. The first loft angle may range from about 18° and about 20°, the second loft angle may range from about 21° and about 23°, and the third loft angle may range from about 24° and about 26°.

The first lie angle may be less than the second lie angle, and the second lie angle may be less than the third lie angle. The first lie angle may range from about 58° and about 60°, the second lie angle may range from about 58.5° and about 60.5°, and the third lie angle may range from about 59° and about 61°.

Each club head has a length (L1) from a hosel center axis to a toe-edge. L1 for the first club head may be greater than L1 for the second club head, and L1 for the third club head may be less than L1 for the second club head. L1 may differ by about 1 to about 4 mm for each club head in the set.

Each club head has a length (L3) from a hosel center axis to a back edge. L3 for the first club head may be greater than L3 for the second club head, and L3 for the third club head may be less than L3 for the second club head. L3 may differ by about 2 mm to about 5 mm for each club head in the set.

Each club head has a length (L5) from a hosel to a ground plane. L5 for the first club head may be greater than L5 for the second club head, and L5 for the second club head may be greater than L5 for the third club head.

In a second aspect of the present invention, the set of golf clubs includes: a first golf club having a first club head with a body defined by a crown, a sole, and a face, and having a first loft angle and a first face height; a second golf club having a second club head with a body defined by a crown, a sole, and a face, and having a second loft angle and a second face height; and a third golf club having a third club head with a body defined by a crown, a sole, and a face, and having a third loft angle and a third face height.

At least one of the first, second, and third club heads may further include a weight pad along the sole. In some instances, each of the first, second, and third club heads further includes a weight pad along the sole.

The weight pad may have a forward surface and a separate top surface. The top surface may extend along a plane parallel to a neutral axis of the club head, the neutral axis passing through a center of the club face perpendicular to an outer surface of the club face.

The weight pad may include a semispherical surface extending through the weight pad and defining a semispherical cavity that opens in the top surface. The semispherical surface may be defined by a constant radius of curvature, or a varying radius of curvature.

In a third aspect of the present invention, the set of golf clubs includes: a first golf club having a first club head with a body defined by a crown, a sole, and a face, and having a first loft angle and a first face height; a second golf club having a second club head with a body defined by a crown, a sole, and a face, and having a second loft angle and a second face height; and a third golf club having a third club head with a body defined by a crown, a sole, and a face, and having a third loft angle and a third face height.

At least one of the first, second, and third club heads may further include a hosel access port in the sole. In some instances, each of the first, second, and third club heads further includes a hosel access port in the sole.

The hosel access port may be located on a heel side of the sole. The hosel access port may also have a configuration for receiving a weight screw. The configuration for receiving the weight screw may be one where the hosel access port is configured to receive a fastening screw along a first axis and receive the weight screw along a second axis, with the second axis being perpendicular to the first axis. Weight screws in each of the first, second, and third golf club heads may differ by about 2 grams or more.

While the several aspects of the present invention may be present separately from one another, they are not exclusive of one another, and may be present in combination.

Both the foregoing general description and the following detailed description are exemplary and explanatory only, and intended to provide further explanation of the invention as claimed. The accompanying drawings provide a further understanding of the invention; are incorporated in and constitute part of this specification; illustrate several embodiments of the invention; and, together with the description, serve to explain the principles of the invention.

BRIEF DESCRIPTION OF THE DRAWINGS

Further features and advantages of the invention can be ascertained from the following detailed description that is provided in connection with the drawings described below.

DETAILED DESCRIPTION OF THE INVENTION

The following disclosure discusses the present invention with reference to the examples shown in the accompanying drawings, and illustrates examples of the invention though does not limit the invention to those examples.

The present invention relates to a set of golf club heads having progressive head sizing such that the size of the club heads in the set decreases as the loft angle of the club heads increases. The present invention also relates to golf club sets including such club heads. The present invention also relates to weighting systems for use with the progressively sized club head set for the purpose of improving balancing characteristics such as center of gravity, MOI, and swingweight. These aspects of the present invention are discussed in greater detail below.

Progressively-Sized Club Heads

The present invention is directed at a set of golf club heads, and in particular a set of hybrid golf club heads, characterized in that the overall size of the club heads sequentially decrease as the loft-angle of the club heads sequentially increase.

Figure 1:
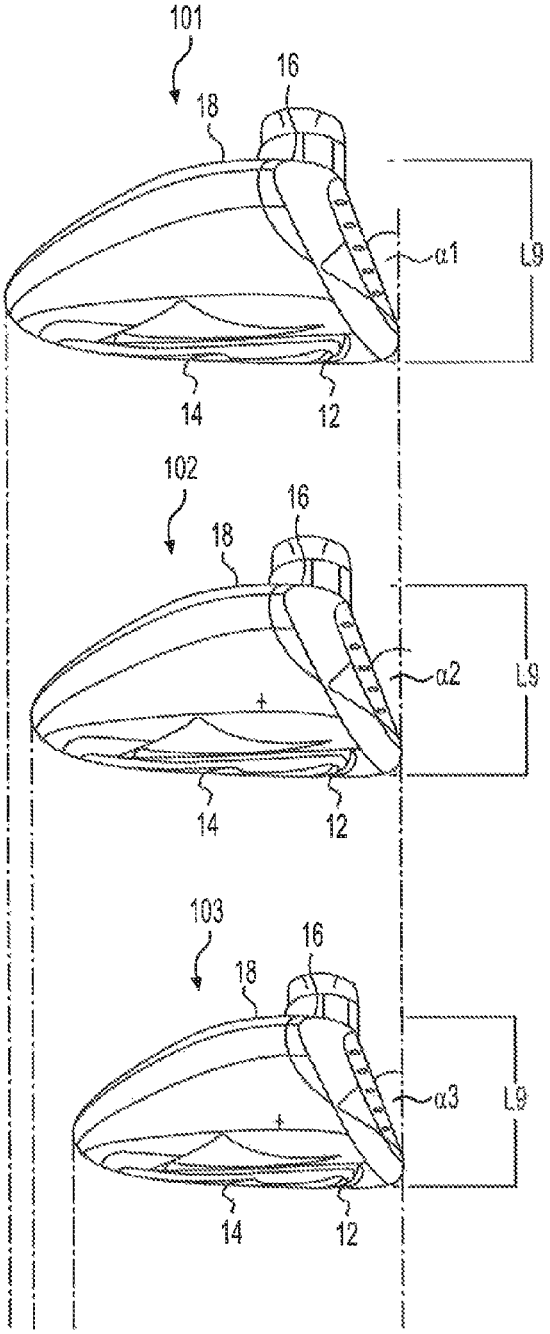
FIG. 1 shows a side view of three sequential club heads in a representative set of club heads according to an embodiment of the present invention.
Figure 2:
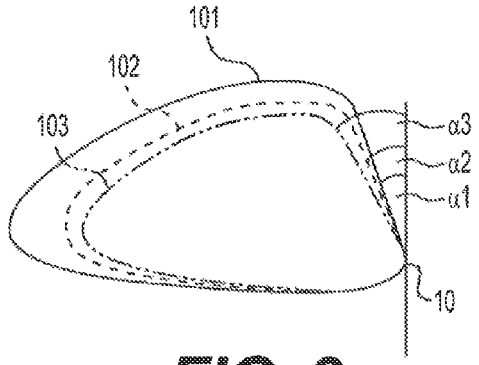
FIG. 2 shows a side view of a comparative profile of the three sequential club heads shown in FIG. 1.
Figure 3:
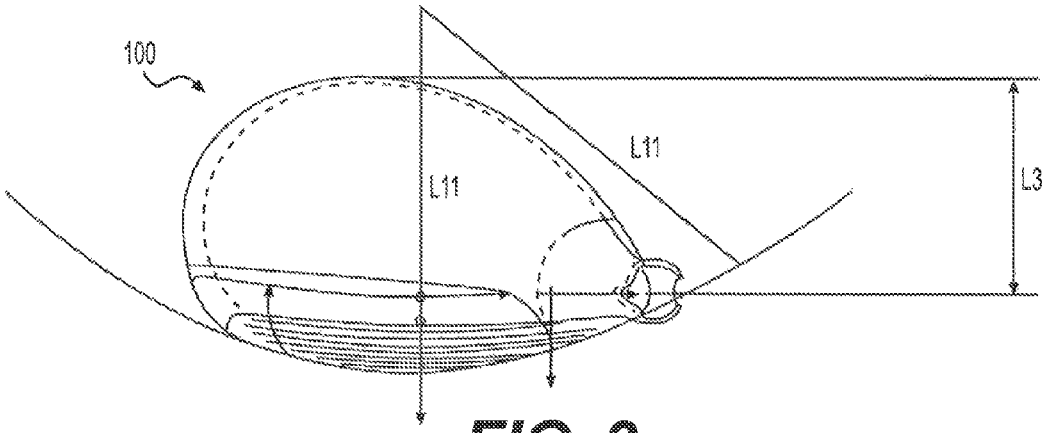
FIG. 3 shows a top plan view of a club head according to an embodiment of the present invention.
Figure 4:
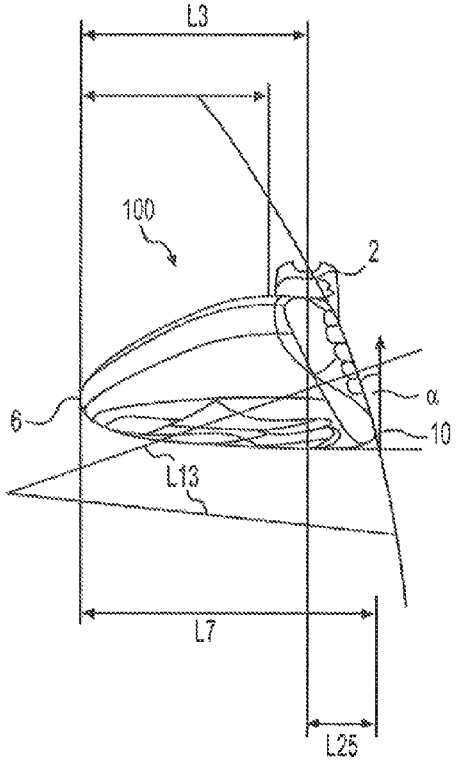
FIG. 4 shows a toe-end side view of the club head in FIG. 3.
Figure 5:
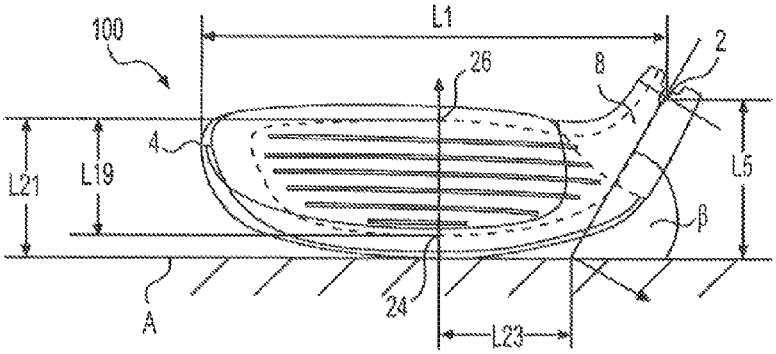
FIG. 5 shows a face view of the club head in FIG. 3.
Figure 6:
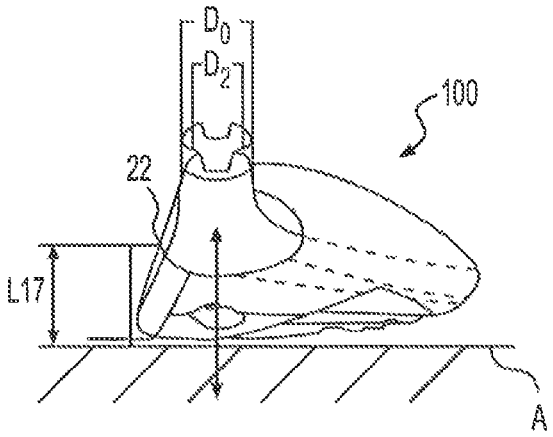
FIG. 6 shows a heel-end side view of the club head in FIG. 3.
Figure 7:
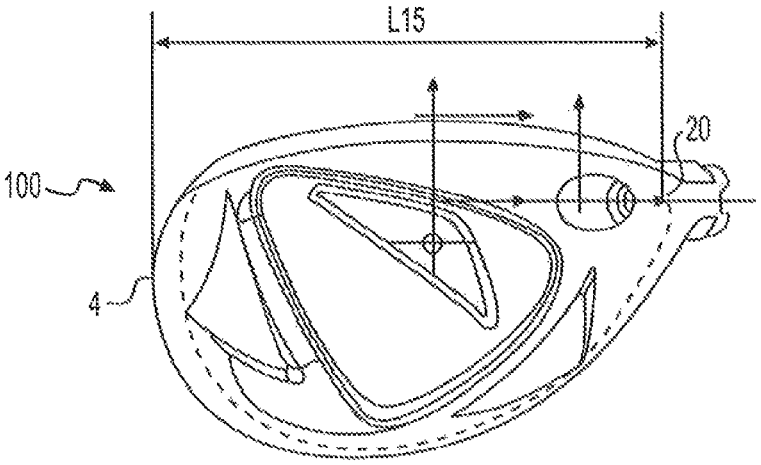
FIG. 7 shows a bottom plan view of the club head in FIG. 3.

FIGS. 1 and 2 illustrate profiles of three golf clubs in a club set, with each successive club head 100 being of decreased size relative to the foregoing club heads. In particular, FIG. 1 illustrates a first club head 101 having a first loft angle $\alpha 1$. FIG. 1 also illustrates a second club head 102 having a loft angle $\alpha 2$ that is larger than the loft angle $\alpha 1$ of the first club head 101, though which has an overall size that is smaller than the first club head 101. FIG. 1 further illustrates a third club head 103 having a loft angle $\alpha 3$ that is larger than both the loft angles $\alpha 1/\alpha 2$ of the first and second club heads 101/102, though which has an overall size that is smaller than both the first and second club heads 101/102. The comparative loft angles and overall sizing of the club heads 101/102/103 may be seen in FIG. 2, wherein the profiles of the three sequential club heads 101/102/103 are overlaid with one another with the leading edge 10 serving as a common point of reference. In the comparative profile shown in FIG. 2, the solid line depicts the first club head 101; the dashed line depicts the second club head 102; and the dashed-dotted line depicts the third club head 103.

The first club head 101, as shown in FIG. 1, may have a loft angle $\alpha 1$ measuring between about 18° and about 20°; preferably between about 18.5° and about 19.5°; and more preferably about 19°. As such, the first club head 101 may be a hybrid club head that replaces a five-wood or a two-iron club head. The second club head 102, as shown in FIG. 1, may have a loft angle $\alpha 2$ measuring between about 21° and about 23°; preferably between about 21.5° and about 22.5°; and more preferably about 22°. As such, the second club head 102 may be a hybrid club head that replaces a three-iron club head. The third club head 103, as shown in FIG. 1, may have a loft angle $\alpha 3$ measuring between about 24° and about 26°; preferably between about 24.5° and about 25.5°; and more preferably about 25°. As such, the third club head 103 may be a hybrid club head that replaces a four-iron club head.

The first club head 101 may have a lie angle $\beta 1$ measuring between about 58° and about 60°; preferably between about 58.5° and about 59.5°; and more preferably about 59°. The second club head 102 may have a lie angle $\Gamma 2$ measuring between about 58.5° and about 60.5°; preferably between about 59° and about 60°; and more preferably about 59.5°. The third club head 103 may have a loft angle $\beta 3$ measuring between about 59° and about 61°; preferably between about 59.5° and about 60.5°; and more preferably about 60°.

As illustrated by FIG. 2, the second club head 102 has a similar shape as the first club head 101, though with a smaller overall size. FIGS. 3-7 depict a club head 100 illustrating a number of dimensions that are taken into consideration when constructing such similarly shaped, though differently sized club heads 101/102/103. In particular, the similar shape and decreased size of the club heads 101/102 is achieved by constructing the second club head 102 in the same manner as the first club head 101, though with a number of dimensions scaled down. For example, the second club head 102 is characterized by scaling down the measurements for at least the following dimensions of the first club head 101: a length L1 measured from the hosel center axis 2 to the toe-edge 4; a length L3 measured from the hosel center axis 2 to the back edge 6; a length L7 measuring the width of the club head 1 (from the leading edge 10 to the back edge 6); a length L9 measuring the crown peak-height (from the lowest point 12 of the sole 14 to highest point 16 of the crown 18; FIG. 1); and a length L15 measuring a heel-edge 20 to toe-edge 4 distance of the club head 1. The scaling factor may range from about 1 percent to about 15 percent. In one embodiment, the scaling factor ranges from about 2 percent to about 12 percent. In another embodiment, the scaling factor ranges from about 2 percent to about 10 percent. In yet another embodiment, the scaling factor from about 2 percent to about 6 percent.

In one embodiment, length L1 (measured from the hosel center axis 2 to the toe-edge 4) is greater for the first club head 101 than the second club head 102. Similarly, L1 is greater for the second club head 102 as compared to the third club head 103. In another embodiment, L1 differs by about 1 to about 4 mm, preferably about 1.8 mm to about 2.2 mm, for each club in the set. In other words, as the loft increases, L1 decreases.

Similarly, in one embodiment, the hosel center axis to back edge L3 decreases as the loft increases. Accordingly, L3 for the first club head 101 is greater than L3 for the second club head 102. L3 for the third club head 103 is less than L3 for the first and second club heads 101/102. In another embodiment, L3 for each successive club head differs by about 2 mm to about 5 mm, preferably about 2.5 mm to about 3.4 mm.

In one embodiment, the hosel length to ground plane (L5) of the first, second, and third club heads 101/102/103 may be the same or different and each range from about 42.4 mm to about 47.6 mm, preferably about 43.7 mm to about 46.3 mm, and more preferably about 45 mm.

In another embodiment, the bulge radius (L11) of the first, second, and third club heads 101/102/103 may be the same or different and ranges from about 204 mm to about 304 mm, preferably from about 229 mm to about 279 mm. In one embodiment, the bulge radius of the clubs is the same. In particular, the bulge radius may be about 254 mm. Similarly, the roll radius (L13) of the first, second, and third club heads 101/102/103 may be the same or different and ranges from about 192 mm to about 292 mm, preferably from about 217 mm to about 267 mm. In one embodiment, the bulge radius of the clubs is the same. In particular, the bulge radius may be about 242 mm.

Although a number of dimensions are scaled between the sequential club heads 101/102, there are also a number of dimensions that remain constant throughout the set. For example, as described above, the hosel length to ground plane (L5) and the bulge and roll radii (L11 and L13, respectively) may be the same for the club heads in the set. Similarly, the wall thickness and area of various portions of the club head including, but not limited to, the crown thickness (proximate to the back of the head), the crown thickness (proximate to the top line), the skirt thickness (proximate to the toe), the skirt thickness (proximate to the heel), the sole thickness (proximate to the back of the head), the sole thickness (proximate to the leading edge), the face flange thickness, and the face insert center area may be the same for the set.

With the foregoing dimensional relationships of scaled dimensions and maintained dimensions, the second club head 102 is made smaller than the first club head 101 while at the same time maintaining common curves and contouring such that the two club heads 101/102 yield a similar swing behavior.

The same adjustments made between the first and second club heads 101/102, regarding scaled and maintained dimensions, are repeated when constructing the third club head 103. In particular, dimensions that were scaled down from the first club head 101 to the second club head 102 are again scaled down from the second club head 102 to the third club head 103; and dimensions that were maintained from the first club head 101 to the second club head 102 are again maintained from the second club head 102 to the third club head 103.

In each of the first, second, and third club heads 101/102/103 the measurements for some dimensions are neither scaled nor maintained, but are instead dictated by the loft-angle $\alpha$ to be conferred to the particular club head 100. For example, when constructing the club heads 101/102/103, the following measurements are determined by the loft-angle $\alpha$ for the particular head: a length L17 measuring the vertical distance from the ground plane A to the face cup center 22; a length L19 measuring the face cup height (between a bottom edge center point 24 and a top edge center point 26); a length L21 measuring the face cup elevated height (between the ground plane A and the top edge center point 26); and a length L25 measuring face progression.

The club heads 101/102/103 may be constructed with progressively increasing finished assembly total weights W. The progressively increasing total weights W allow each club head 101/102/103 to confer a target balance to the individually assembled clubs, upon being matched with corresponding club shafts, to thereby provide each of the separately assembled clubs with a common swing weight. Though the difference in total weight W between sequential club heads in a given set will vary depending on the change in length between the corresponding shafts, a difference in total weight W between the successive clubs heads 101/102/103 may, generally, be from about 5 grams to about 8 grams; preferably from about 6 grams to about 7 grams.

The club heads 101/102/103 may be constructed of metal, plastic or composite materials, including but not limited to: stainless steel alloys (465 SS; 17-4 SS; etc.); titanium alloys; aluminum alloys; and the like. Composite club heads may be constructed with separate components being formed from different materials. For example, a two-piece composite club head 100 may be constructed using 17-4 stainless steel for the crown, skirt and sole and 465 stainless steel for the face cup.

With the progressively decreasing size of the sequentially lofted club heads 101/102/103, a club set may be constructed with club heads that appear similarly shaped, though with sequentially decreasing footprint sizes, when viewed on address (i.e., a top down view of the club head, as seen from a player's perspective, when holding the club in a pre-swing position). This uniform appearance of the similarly shaped club heads, with progressively decreasing dimensions, presents an appealing aesthetic to the club set that is expected to enhance a player's confidence and performance. In addition, the progressively decreasing size of the sequentially lofted club heads 101/102/103 is expected to confer favorable aerodynamics by providing each sequential club with a common aerodynamic behavior (e.g., due to the similar shape of the clubs) and decreased aerodynamic drag (e.g., due to the decreased cross-sectional area of each sequential club).

Addition, the club heads 101/102/103 are formed with a particular total weight W for achieving a target weight balancing in the assembled clubs in order to provide each club with a common swingweighting. In particular, the total weights W of the club heads 101/102/103 are characterized in that they increase sequentially as the loft angles α1/α2/α3 increase. This increase in weight occurs even though the club heads 101/102/103 decrease sequentially in overall volumes V and maintain constant wall thicknesses T1-T8. In the present invention, this inverse relationship of total weight W to decreasing volume V is achieved by the inclusion of one or more weighting systems.

Weight Body Weighting System

Figure 8:
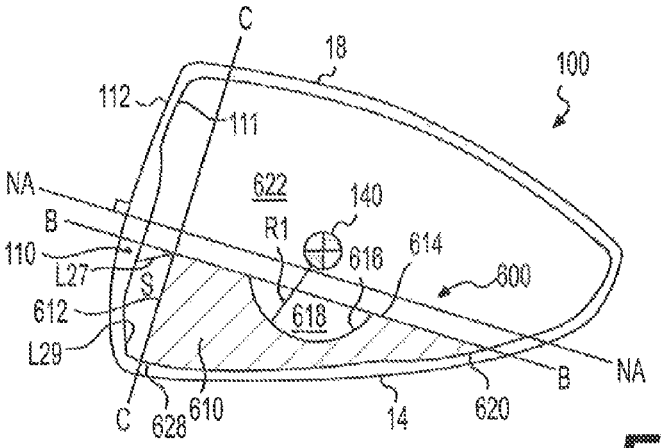
FIG. 8 shows a side cross-sectional view of a first weighting system according to an embodiment of the present invention.

FIG. 8 illustrates a first weighting system 600 that may be used to weight a club head 100 of the present invention. In the example shown in FIG. 8, the weighting system 600 includes a weight body 610 having a forward surface 612 that is separated from an inner surface 111 of the face 110 by a space S; a top surface 614; and a semispherical surface 616 that extends through the weight body 610 to define a semispherical cavity 618 that is open in the top surface 614.

While the specific embodiment discussed here relates to a club head with a face cup, the invention is not limited to this manufacturing method. In particular, the golf club head may be manufactured using various methodologies of manufacturing to form the striking face.

In the example shown in FIG. 8, the top surface 614 extends along a plane B that is parallel to the neutral axis NA of the club head 100. The neutral axis NA is the axis that passes through the center 22 of the face cup 110 and has a perpendicular orientation relative to the outer surface 112 of the face cup 110. The top surface 614 meets with the sole 14 at a rearward end 620 and slopes upwardly toward the crown 18 as it extends toward the face cup 110 and terminates at a forward most point 622. Because the top surface 614 extends along a plane B that is parallel with the neutral axis NA, the slope of the top surface 614 will match the slope of the neutral axis NA.

Figure 9:
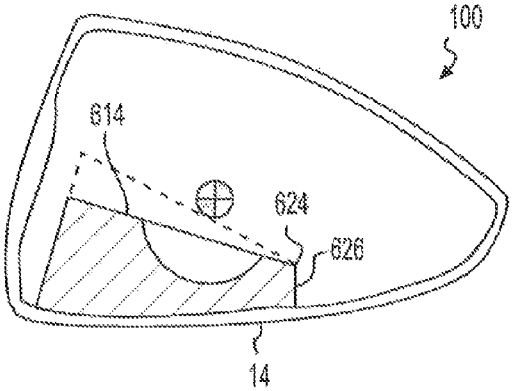
FIG. 9 shows a side cross-sectional view of another example of the weighting system of FIG. 8.

In other examples, such as that shown in FIG. 9, the rearward end 620 of the top surface 614 may not meet with the sole 14, and may instead come to an end at a rearward end point 624 that is elevated above the sole 14. In such an example, a rearward surface 626 will span between the rearward end point 624 of the top surface 614 and the sole 14. In another example, plane B may not be parallel to the neutral axis NA. Plane B may be tilted back to move the center of gravity 140 lower and further back away from the neutral axis NA. Plane B may also be tilted forward to make the center of gravity 140 higher and closer to the face, yet further away from the neutral axis NA. In yet another example, plane B may be tilted heal-ward or toe-ward to create a heal-biased or toe-biased center of gravity 140, respectively.

As shown in the example of FIG. 8, the forward surface 612 of the weight body 610 may extend along a plane C that is perpendicular to the neutral axis NA. The forward surface 612 is separated from the inner surface 111 of the face cup 110 by a space S. The space S is at least an amount sufficient to prevent the face cup 110 from contacting the weight body 610 upon an inward deflection of the face cup 110 when striking a golf ball. In some examples, the space S is an amount sufficient not only to prevent contact of the face cup 110 with the weight body 610, but is also an amount sufficient to prevent the weight body 610 from conferring any undesired stress influences to the deflection characteristics of the face cup 110. For example, though not being bound by theory, it is considered that if a lower forward-most point 628 of the weight body 610 is positioned too closely to the inner surface 111 of the face cup 110, the structural rigidity of the weight body 610 may result in an increased stiffness to the structural support of the face cup 110 at a region where the face cup 110 meets the sole 14. Such an increased stiffness may alter the deflection characteristic of the face cup 110 and, thereby, the trajectory of golf balls struck by the club head 100 (e.g., a stiffened lower region in the face cup 110 could decrease the potential loft of the club head 100). Thus, in some examples, the space S will be sufficient to prevent the weight body 610 from generating any undesired stiffening to the structural support of the face cup 110. Construction of the weight body 610 with a space S also facilitates construction of the club head 100 by metal shaping procedures, such as casting and molding processes.

Although precise measurements for the space S will depend on the nature of the face cup 110, and its deflection characteristics, a weight body 610 formed in a club head of the present invention may have a length L27 measured horizontally between the inner surface 111 of the face cup 110 and the top point 622 of the forward surface 612 measuring between about 0.5 mm and about 15.0 mm, preferably between about 2.0 mm and about 5.0 mm, and more preferably about 3.6 mm; and a length L29 measured horizontally between the inner surface 111 and the lower forward most point 628 of the forward surface 612 measuring between about 0.5 mm and about 15.0 mm, preferably between about 1.0 mm and about 4.0 mm, and more preferably about 2.5 mm. These ranges are applicable to each of the club heads 101/102/103.

The semispherical surface 616 in the weight body 610 defines a semispherical cavity 618. In the example shown in FIG. 8, the semispherical surface 616 is characterized, generally, by a constant radius of curvature R1 measured relative to a center of gravity 140 of the club head 100. In particular, the radius of curvature R1 defining the semispherical surface 616 is measured from a point in space within the club head 100 that is calculated to represent the center of gravity 140 for the club head 100 with the weight body 610 present therein.

As will be described further below, the formation of the semispherical cavity 618 in the weight body 610 increases the MOI of the club head 100 while at the same time minimizing a resultant shift in the center of gravity 140. This is achieved, for example, by removing a mass of material 412 that is closest to the center of gravity 140 and placing that removed mass of material 412 at a location further from the center of gravity 140. In this manner, the radius of curvature R1 of the semispherical surface 616 is chosen based on the desired MOI to be conferred to the club head 100, with a larger radius of curvature R1 resulting in a larger increase to the MOI. In a club head of the present invention, a weight body 610 may have a semispherical surface 616 with a radius of curvature R1 measuring between about 5 mm and about 100 mm, and preferably between about 20 mm and about 60 mm. These ranges are suitable for each of the club heads 101/102/103.

Figure 10:
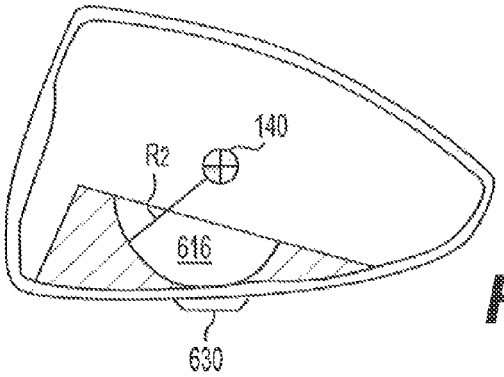
FIG. 10 shows a side cross-sectional view of another example of the weighting system of FIG. 8.
Figure 12:
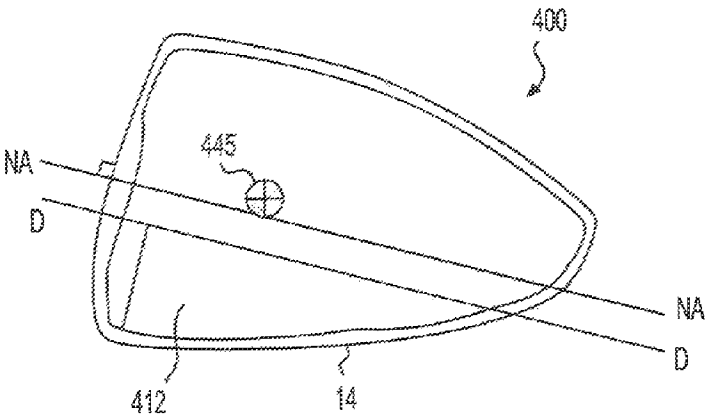
FIGS. 11-16 show a method for forming the weighting system of FIG. 8.

Although it is preferred that the semispherical surface 616 be defined by a constant radius of curvature R1, as shown in the example of FIG. 8, the semispherical surface 616 may in some examples be formed with a non-constant radius of curvature R2, as shown in FIG. 10. In particular, if the desired MOI for a particular club head 100 requires a radius of curvature that exceeds a distance measured between the center of gravity 140 and an outer wall of the club head 100, then the semispherical surface 616 will be inclusive of a non-spherical surface region 630 corresponding to one or more locations where the radius of curvature required for the desired MOI exceeds the distance to the outer wall. In some examples, the semispherical surface 616 may be large enough to break through the front wall 612, the rear most point 620, the front most point 628, or combinations of two or more walls.

Figure 11:
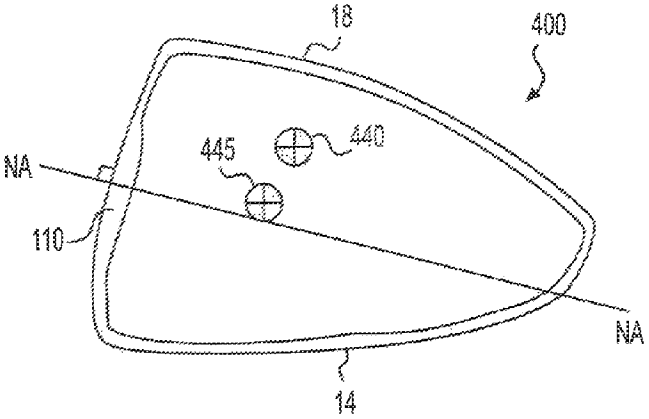

The weight body 610 may be constructed by generating a model club head 400 having a face cup 110; a crown 18; and a sole 14, as shown in FIG. 11. The model club head 400 may be either a physical model or a virtual model. A neutral axis NA and a principal center of gravity 440 of the model club head 400 are then calculated, based on the shape, dimensions, and estimated mass of the model club head 400. The equations for these calculations are known to those skilled in the art. A target center of gravity 445 is then identified in the model club head 400. Preferably, the target center of gravity 445 is a point above the neutral axis NA, or close thereto. An estimation is made as to a volume of material that must be added in order to shift the center of gravity of the model club head 400 from the principal center of gravity 440 toward the target center of gravity 445. A mass of material 412 is then added below a plane D that is parallel with the neutral axis NA to thereby form a surface 406 in the mass of material 412 that is parallel to the neutral axis NA. The plane D is set at a distance from the neutral axis NA based on the overall club head weight.

Depending on the location of the principal center of gravity 440 relative to the neutral axis NA, it may be necessary to affect a shift in the center of gravity in either a partial toe-direction or a partial heel direction in order to shift the principal center of gravity 440 toward the target center of gravity 445. In such instances, the plane D, along which the surface 406 is created, may be rotated about the neutral axis NA to thereby achieve either a toe-end weighting or a heel-end weighting as needed to achieve the desired shift.

Figure 14:
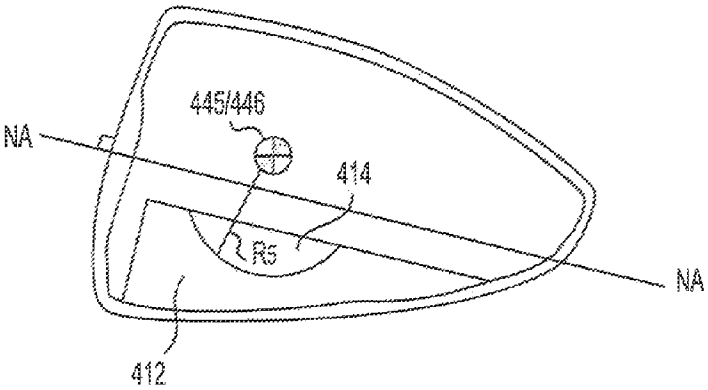
Figure 13:
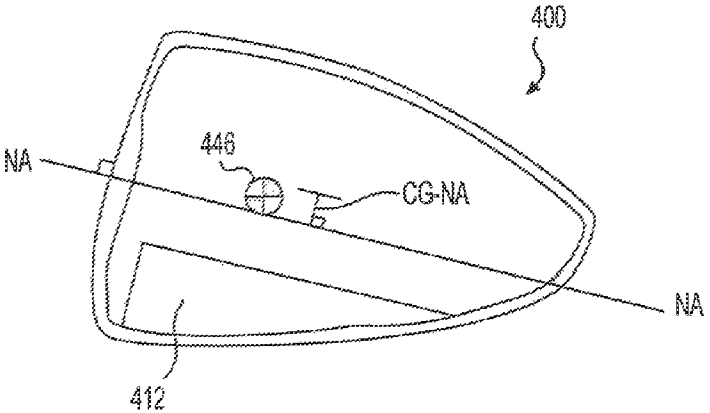
Figure 15:
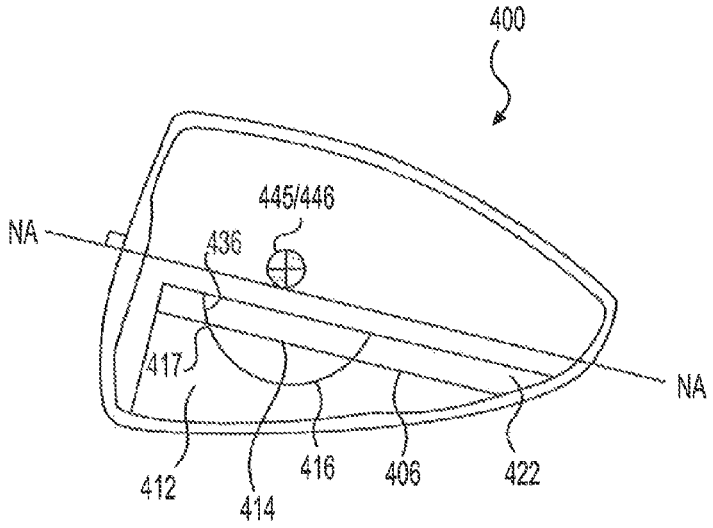
Figure 16:
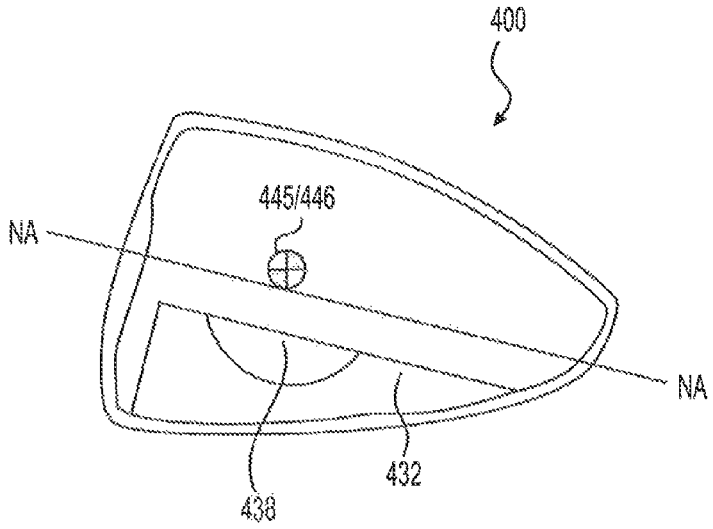

By the foregoing process, the additional mass of material 412 shifts the principal center of gravity 440 located above the neutral axis NA to a resultant center of gravity 446. Ideally, the resultant center of gravity 446 is one in the same with the target center of gravity 445, located close to the neutral axis NA, as illustrated by FIGS. 14-16. However, as it may be difficult to align the center of gravity perfectly on the neutral axis NA, it is acceptable to generate a resultant center of gravity 446 that is offset from the neutral axis NA by a distance CG-NA, as shown in FIG. 13. The distance CG-NA may measure between about −5 mm (5 mm below the neutral axis NA) and about 20 mm (20 mm above the neutral axis NA), preferably between about 0 mm and about 15 mm, and more preferably between about 1 mm and about 4 mm.

After modeling the foundation layer 412, an estimation is made of the MOI of the modeled club head 400 with the modeled foundation layer 412 present therein; and a difference is determined between the estimated MOI and a target MOI for the modeled club head 400. A volume of material located within a predetermined radius R5 of the resultant center of gravity 446 is then removed from the foundation layer 412 to form a semispherical cavity 414 in the foundation layer 412. The removed volume of material is than redeposited on the surface 406 of the foundation layer 412 about the perimeter of a semispherical cavity 414 as a build-up layer 422, as shown in FIG. 15. When the volume of removed material is redeposited on the surface 406 of the foundation layer 412, it is deposited in a manner as to form a curved surface 426 that aligns with a curved surface 416 that was formed in the foundation layer 412 when the volume of material was initially removed. In this way, there is formed a semispherical surface 436 with a smoothly continuous curvature over a boundary 437 from the foundation layer 412 to the deposited build-up layer 422.

Upon completing the foregoing process, including the removal of a volume of mass within a predetermined radius R5 of the resultant center of gravity 446, and the redepositing of that volume of material around the periphery of the semispherical cavity 414, the foundation layer 412 and the build-up layer 422 together thus generate as a modeled weight body 432 having a semispherical cavity 438 formed therein with a radius of curvature measured from the resultant center of gravity 446. This semispherical cavity 438, generated by the removal and redeposition of a volume of material in the foregoing manner, adjusts the ratio of central mass relative to perimeter mass in such a way that the MOI of the modeled club body 400 is increased. In addition, because the volume of material redeposited on the top surface 406 of the foundation layer 412 is the same volume of material that was removed from the foundation layer 412, the overall mass of the modeled weight body 432 remains constant while the location of the resultant center of gravity 446 moves up and back further away from the neutral axis NA, with the change in location of the resultant center of gravity 446 being dependent upon the amount of the desired MOI increase. In particular, the smaller the radius of curvature R5 used to remove a volume of mass, the greater the increase to the MOI and the greater the shift in the location of the resultant center of gravity 446. In particular, as the radius of curvature decreases the mass of the weight body 432 will be distributed at higher elevations. While the higher elevated mass distribution will result in a further increased MOI, it will also tend to shift the resultant center of gravity 446 in upward and rearward directions, away from the neutral axis NA. As such, there is a tradeoff between maintaining the location of the center of gravity and increasing MOI.

Once the modeled weight body 432 is generated for a model club head 400, construction of a club head 100 with a weight body 610 is performed by forming a weight body 610 with the dimensions of the modeled weight body 432. The weight body 610 may be constructed either monolithically with a club head 100 (e.g., as a projection from the sole of a monolithic club head), or by forming the weight body 610 monolithically with a component of a multi-component club head (e.g., as a projection from a sole component of a multi-component club head). A monolithically formed weight body 610 may be constructed through casting, forging, and like processes. Alternatively, the weight body 610 may be formed as a separate component and then integrally joined with a club head 100 during assembly. For example, a separately formed weight body 610 may be welded to an inner surface of a sole, or it may be joined to an inner surface of a sole by a fastener. Suitable fasteners may include, but are not limited to: a screw; a male-female connection; a tongue-and-groove connections; and the like.

Figure 17:
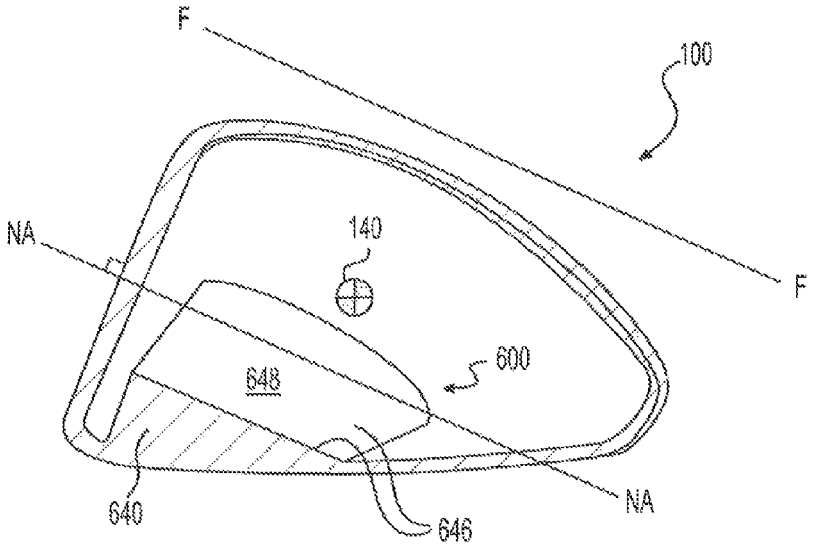
FIG. 17 shows a side cross-sectional view of another embodiment of the weighting system of FIG. 8.

FIG. 17 illustrates another example of the first weight system 600, in the form of a weight body 640 that may be used to weight one or more club heads of the present invention. The weight body 640 is similar to the earlier discussed weight body 610, and is formed by a similar method as that used to form the weight body 610, with the exception that in place of a semispherical surface 616 defining a semispherical cavity 618 the weight body 640 instead has a semicylindrical surface 646 defining a semicylindrical cavity 648. As such, the following discussion of the weight body 640 addresses only differences between the first and second weight bodies 610/640.

Figure 18:
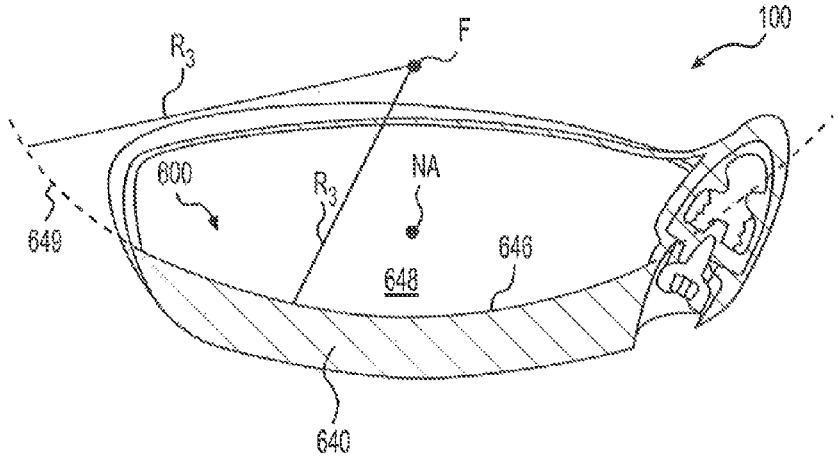
FIG. 18 shows a face cross-sectional view of the weighting system of FIG. 17.

As shown in FIGS. 17 and 18, the semicylindrical surface 646 is characterized, generally, by a semicircular cross-section 649 having a constant radius of curvature R3 measured relative to an axis F that extends parallel to the neutral axis NA, with the semicircular cross-section 649 extending along the axis F to thereby define the semicylindrical cavity 648. As shown in the example of FIGS. 17 and 18, the axis F that extends in parallel with the neutral axis NA is an axis that does not pass through the club head 100, such that the radius of curvature is relatively large. In other examples however, when the radius of curvature is relatively smaller, the axis F may be an axis extending through the club body 100 and may, in some instances, be the neutral axis NA itself.

The weight body 640 is formed by a similar modeling process as that used for forming the weight body 610. In particular, the same steps are performed for generating a modeled club head 400 with a modeled foundation layer therein to thereby shift a principal center of gravity to a resultant center of gravity that ideally corresponds with a target center of gravity located along, or substantially close to, the neutral axis NA. Similar to the process for the weight body 610, a volume of material that is calculated to result in a desired MOI is then removed from the modeled foundation layer and redeposited on a surface of the modeled foundation layer as a build-up layer. However, whereas the process for forming the weight body 610 included removing a semi-spherical volume of material from the modeled foundation layer 412, based on a radius of curvature measured from the resultant center of gravity 446, and then redepositing the removed volume of material about the periphery of a semi-spherical cavity 414; the process for forming the weight body 640 instead includes removing a semicylindrical volume of material from the modeled foundation layer based on a radius of curvature measured from an axis F that extends parallel to the neutral axis NA, and then redepositing the removed volume of material about the periphery of a semicylindrical cavity.

Figure 19:
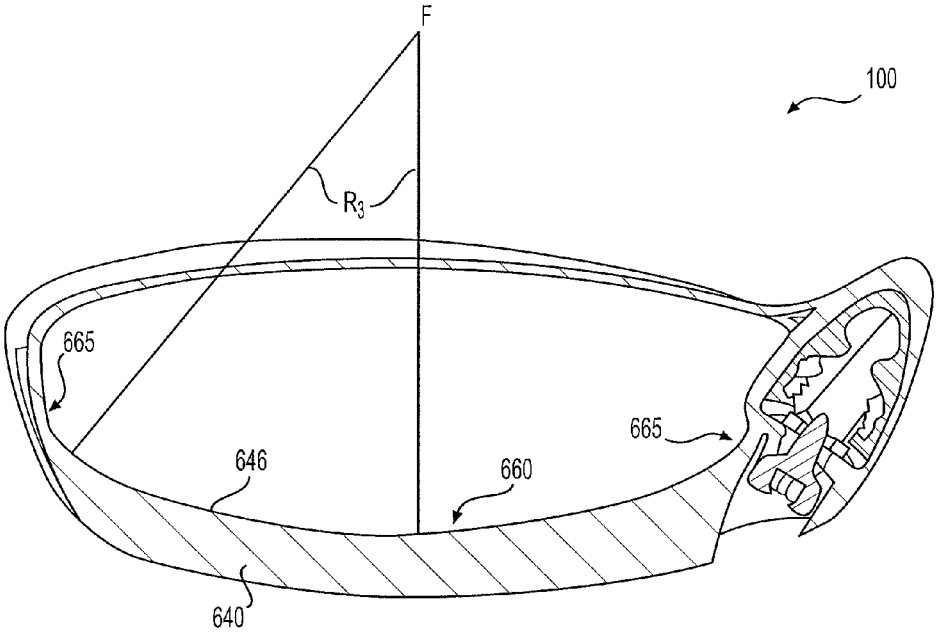
FIG. 19 shows a face cross-sectional view of another example of the weighting system of FIG. 17.
Figure 20:
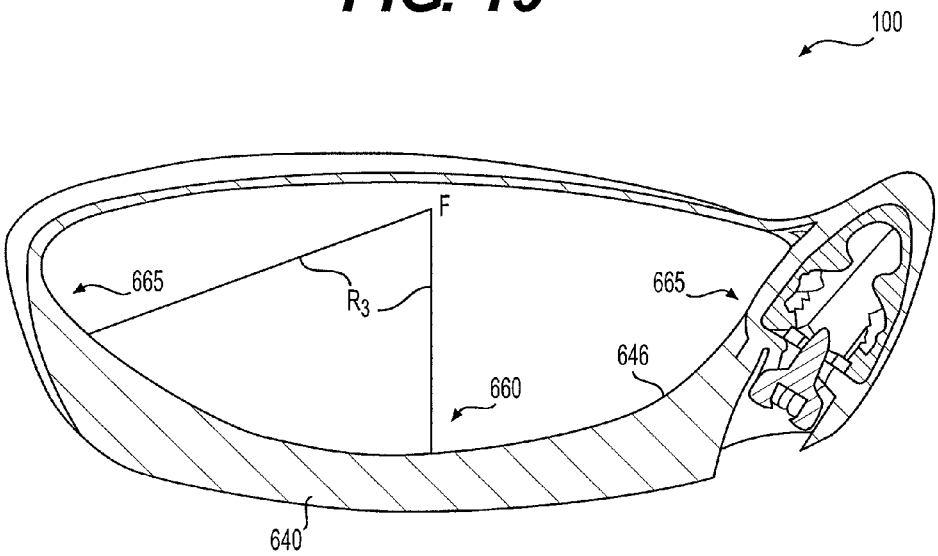
FIG. 20 shows a face cross-sectional view of another example of the weighting system of FIG. 17.

When forming the weight body 640, the radius of curvature R3 is chosen based on the desired MOI to be conferred to the club head 100. When considering the radius of curvature to be constant in the semicylindrical surface 646, it is understood that a significantly large radius of curvature R3 will generate a lesser curved semicylindrical surface 646, such as that shown in FIG. 19, and that a smaller radius of curvature R3 will generate a greater curved semicylindrical surface 646, such as that shown in FIG. 20. As such, the smaller the radius of curvature R3 used to form the semicylindrical surface 646, the larger the mass of material that will be shifted from a lower center region 660 of the weight body 640 and to the higher peripheral regions 665 of the weight body 640; and thus the larger the increase to the MOI of the club head 100. A weight body 640 used in a club head of the present invention may have a semicylindrical surface 646 with a radius of curvature R3 measuring between about 80 mm and about 1,000 mm; preferably between about 100 mm and about 1600 mm; and more preferably between about 120 mm and about 220 mm. The foregoing ranges for the radius of curvature R3 are suitable for each of the club heads 101/102/103.

By the foregoing process, with the removal of a volume of mass within a radius R3 measured from an axis F extending parallel to the neutral axis NA, there will be incurred a shift in the location of the target center of gravity 140. In some examples, the axis F may be rotated forward (toward the face cup 110) to move the target center of gravity 140 further backward toward the rear end 620, or the axis F may be rotated backward (toward the rear end 620) to thereby move the target center of gravity 140 further forward toward the face cup 110. In some examples, the axis F may be moved heal-ward or toe-ward to impart an opposite effect on the target center of gravity 140. In particular, as axis F moves heal-ward, the target center of gravity 140 moves toe-ward, and vice-versa. In some examples the axis F may be rotated forward or backward in combination with a heal-ward or toe-ward shift.

The smaller the radius of curvature R3 used to remove a volume of mass relative to the axis F, the greater the curvature of the semicylindrical surface and the greater the increase to the MOI; but also the greater the shift in the location of the target center of gravity 140. In particular, as the radius of curvature decreases the curvature of the semicylindrical surface will increase, and the mass of the weight body will be distributed at higher elevations. While the higher elevated mass distribution will result in a further increased MOI, it will also tend to shift the resultant center of gravity 140 in upward and rearward directions, away from the neutral axis NA. As such, there is again a tradeoff between maintaining the location of the center of gravity and increasing MOI. The semicylindrical character of the weight body 640 may prove less effective than the weight body 610 in achieving both a target center of gravity and a target MOI. However, because formation of the semispherical surface 618 in the weight body 610 is considered more complicated than formation of the semicylindrical surface 648 in the weight body 640, the weight body 640 may prove easier to manufacture and therefore more cost effective for mass production.

Weight Screw Weighting System

Figure 21:
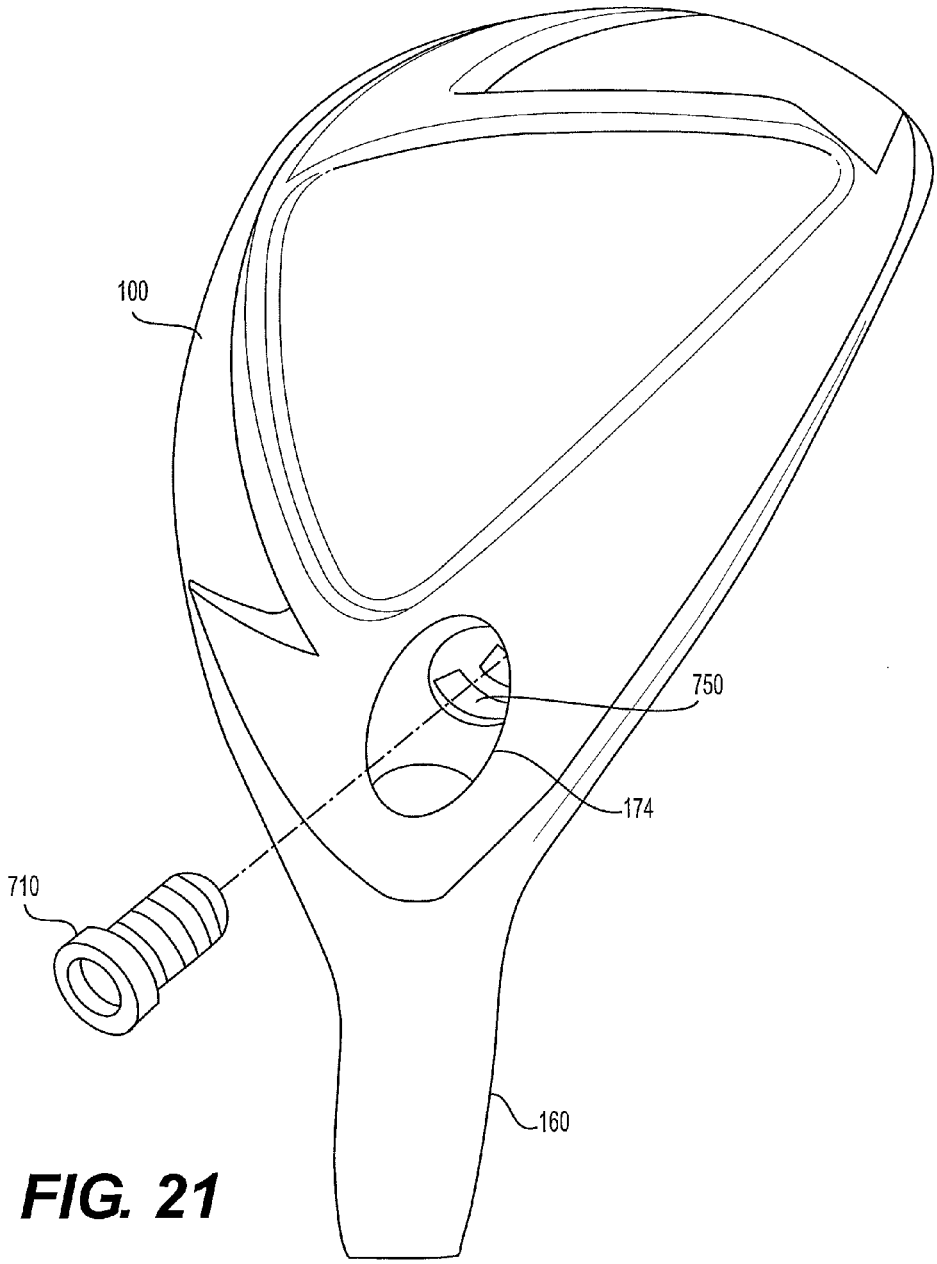
FIG. 21 shows a second weighting system according to an embodiment of the present invention.

FIG. 21 illustrates a second weighting system 700 that may be used to weight one or more club heads of the present invention. In particular, the second weighting system 700 includes a combined weight screw 710 and screw port 750 that may be used in club heads 100 having an adjustable hosel 160.

Figure 22:
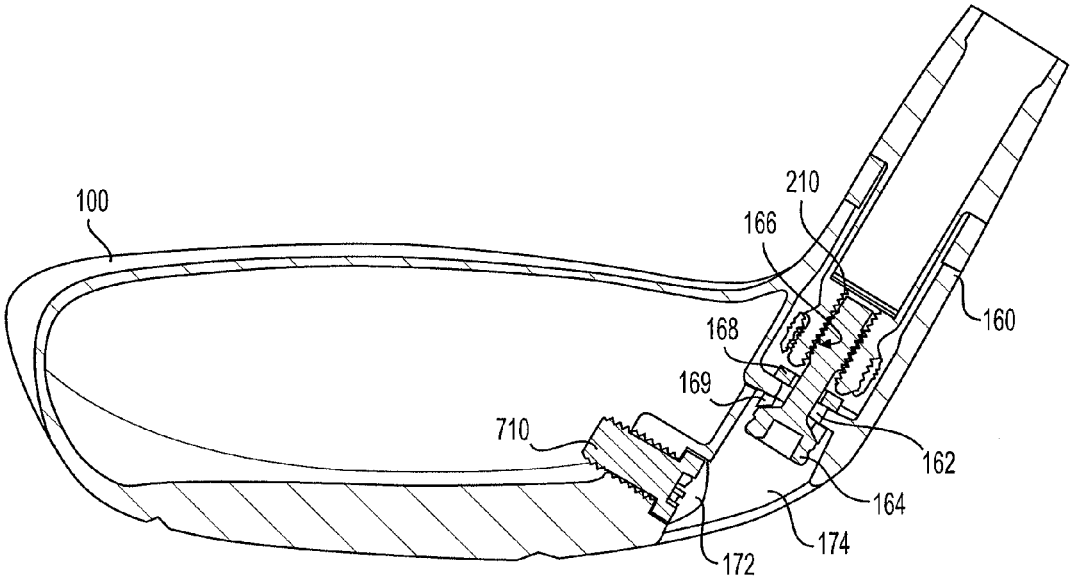
FIG. 22 shows a face cross-sectional view of the weighting system of FIG. 21.

The club heads of the invention may include an adjustable hosel. In the present invention, as shown in FIG. 22, the adjustable hosel 160 includes a fastening screw port 162 that receives an adjustable fastening screw 164 having threads 166 that mate with threads 210 in a club shaft 200 to thereby secure the club shaft 200 in the hosel 160. One or more elastic washers 168/169 may be arranged about the fastening screw port 162, to cushion an abutment between the club shaft 200 and the hosel 160 and/or to cushion an abutment between the fastening screw 164 and the hosel 160. An access port 172 is formed in the heel-end of the club head 100, with an access port opening 174 positioned about the sole 14 and the heel 28. The access port 172 and opening 174 enable access to the adjustable fastening screw 164 to permit a user to adjust the connection between the club head 100 and the club shaft 200 to thereby vary the performance characteristics of the club (e.g., varying the lie angle, the loft angle).

Figure 23:
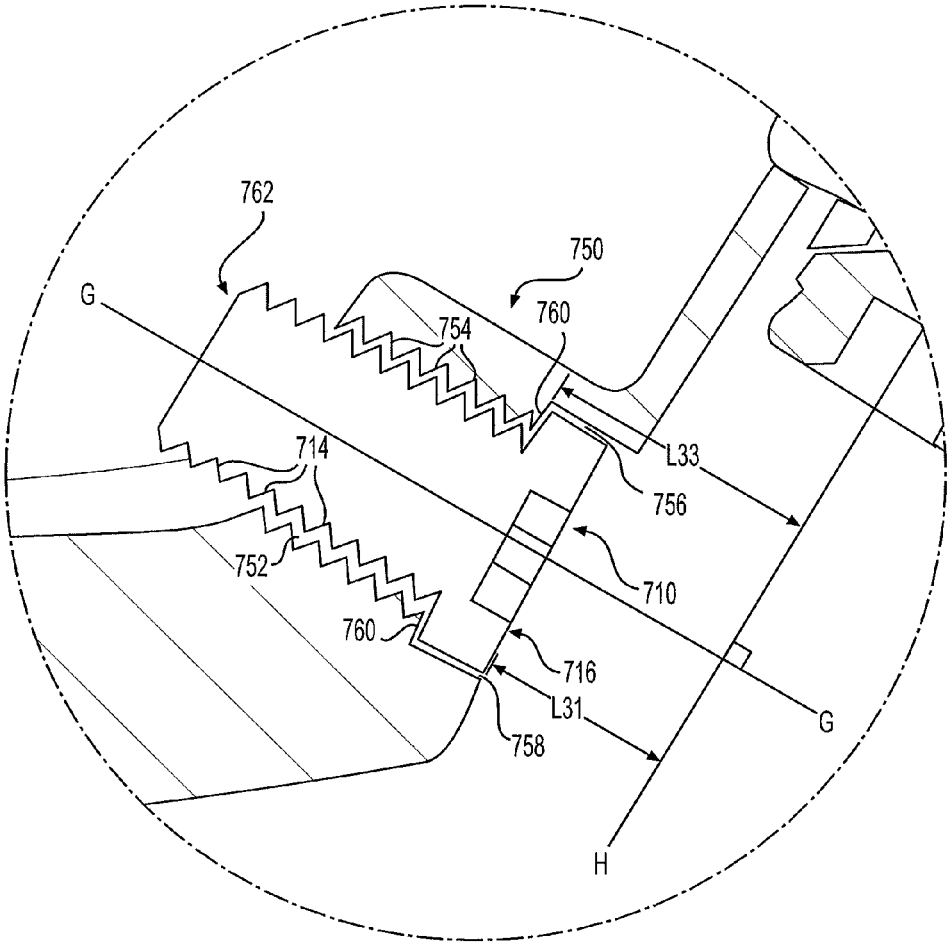
FIG. 23 shows closer view of the cross-sectional view of FIG. 22.

As shown in FIG. 23, the screw port 750 of the weight system 700 includes a bore 752 configured to receive a weight screw 710, with a length of thread 754 extending along the bore 752 for mating with a thread 714 on the weight screw 710. An annular chamber 756 is located at an external end of the bore 752 for receiving an annular head 716 of a received weight screw 710, the annular chamber 756 having an opening 758 at one end for insertion of the weight screw 710 and a shoulder 760 at another end for abutment with a lower edge of the screw head 716. The screw port 750 is oriented such that a central axis G of the bore 752 extends in a direction perpendicular to an axis H representing the central axis of the fastening screw port 162, which is also the central axis of the club shaft 200. With this perpendicular orientation of the weight screw port 750 and the fastening screw port 162, a tool may be inserted in a first direction corresponding with the central axis H for manipulating the adjustable fastening screw 164; and may be inserted in a second direction corresponding with the central axis G for manipulating the weight screw 710.

An access port 172 of the present invention may be formed by expanding an access port in a club head having an adjustable hosel by adding between about 2° to about 4° of draft; and preferably about 3° of draft. The screw port 172 may be constructed such that the annular head 716 of the weight screw 710 is positioned substantially adjacent, and preferably as close as possible, to the central axis H of the club shaft 200.

Measurements for length L31 between the opening 758 and the central axis H, as well as length L33 between the shoulder 760 and the central axis H, may vary depending on screw sizes and the adjustable hosel configuration dimensions.

Figure 24:
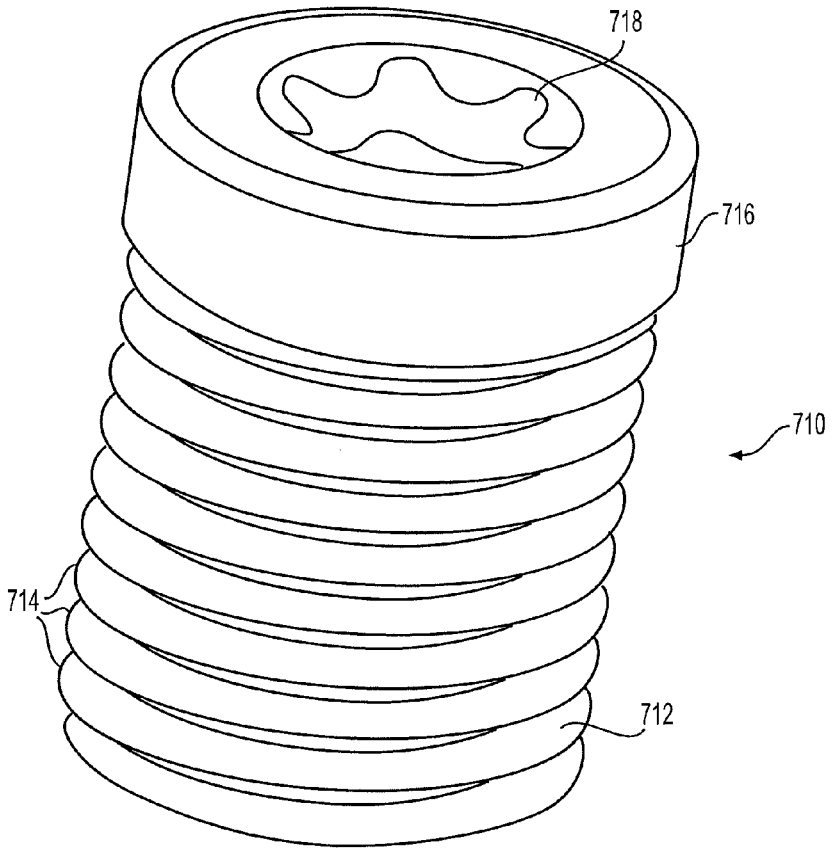
FIG. 24 shows a weight screw used in the weighting system of FIG. 21.

As shown in FIG. 24, the weight screw 710 for use in the weighting system 700 includes a shaft 712 having a length of thread 714 for mating with the corresponding thread 754 in the screw port 750, and an annular head 716 at an end of the shaft 712. The annular head 716 includes a socket 718 for receiving a tool that facilitates insertion and tightening of the weight screw 710 into the screw port 750.

The weight screw 710 may be made from a number of different materials, with a number of different lengths and masses, as needed to achieve a target weighting in a particular club head. For example, a first weight screw 705 may be made from 6-4 titanium, with a length between about 4 cm and about 12 cm, preferably between about 7 cm and about 9 cm, and more preferably about 8 cm; a mass between about 1 g and about 6 g, preferably between about 1 g and about 3 g, and more preferably about 2.02 g; and a target mass between about 2.0 g and about 2.32 g, preferably between about 2.08 g and about 2.24 g, and more preferably about 2.16 g. As used in this context, the term "target mass" refers to the range of weight preferred for reasonable user weight changes, that can be detected during the swing (e.g., approximately 5 g increments). In another example, a second weight screw 706 may be made from 17-4 stainless steel, with a length between about 6 cm and about 15 cm, preferably between about 9 cm and about 11 cm, and more preferably about 10 cm; a mass between about 2 g and about 8 g, preferably between about 3 g and about 5 g, and more preferably about 4.16 g; and a target mass between about 4.0 g and about 4.32 g, preferably between about 4.08 g and about 4.24 g, and more preferably about 4.16 g. In a further example, a third weight screw 707 may be made from 17 g/cc tungsten, with a length between about 4 cm and about 8 cm, preferably between about 5 cm and about 7 cm, and more preferably about 5.7 cm; a mass between about 4 g and about 9 g, preferably between about 5 g and about 7 g, and more preferably about 6.07 g; and a target mass between about 6.0 g and about 6.32 g, preferably between about 6.08 g and about 6.24 g, and more preferably about 6.16 g. In a yet further example, a fourth weight screw 708 may be made from 17 g/cc Tungsten, with a length between about 6 cm and about 12 cm, preferably between about 7 cm and about 9 cm, and more preferably about 8.5 cm; a mass between about 5 g and about 10 g, preferably between about 7 g and about 9 g, and more preferably about 8.05 g; and a target mass between about 8.0 g and about 8.32 g, preferably between about 8.08 g and about 8.24 g, and more preferably about 8.16 g.

| VERSION | MATERIAL | MASS | TARGET MASS | LENGTH |
|---|---|---|---|---|
| TYPE 1 | 6-4Ti | 2.02 | 2.16 | 8 |
| TYPE 2 | 17-4 | 4.16 | 4.16 | 10 |
| TYPE 3 | 17G/CC W | 6.07 | 6.16 | 5.7 |
| TYPE 4 | 17G/CC W | 8.05 | 8.16 | 8.5 |

In one aspect, the weight screw 710 is configured for permanent fixture within a screw port 750. In another aspect however, a screw weighting kit 730 may include each of the screw weights 705/706/707/708, and the screws may be configured for temporary fixture within a screw port 750 such that a user may selectively insert, remove, and interchange screw weights in a particular club head 100 to adjust the club head weighting as desired. The screw weighting kit 730 may include only the four screws 705/706/707/708, or it may include yet further screws having further varying lengths and masses, and made from the same or other suitable materials. Suitable materials for constructing a weight screw include, but are not limited to: titanium alloys; aluminum alloys; tungsten alloys; brass; and the like.

In addition to providing a mechanism that allows for adjustment of the swingweighting of a club having an adjustable hosel configuration, the weight system 700 also provides a concealed port for the injection of an adhesive into the club head 100. In particular, the screw port 750 includes an opening 762 at an inner end of the bore 752 that opens into and communicates with an internal volume of the club head 100, which provides a port for injecting an adhesive into the internal volume. In particular, a desired volume of adhesive may be fed through the bore 752 and injected into the inner volume of the club head 100 through the opening 762. In a club head that receives a permanently fixed weight screw 710, this introduction of adhesive is performed during assembly of the club head prior to a first use by an end user. In a club head that receives a removable weight screw 710, the adhesive may be introduced either during assemble, prior to a first use by an end user; or it may be done during the useful lifetime of the club head by removing an inserted weight screw and introducing an adhesive. In either instance, care must be is taken when introducing the adhesive to avoid applying the adhesive onto the threads 754 along the bore 752, as this will interfere with the reception of a weight screw 710. After a desired volume of adhesive has been introduced into the club head 100, a weight screw 710 is inserted into the screw port 750, thereby covering and concealing the opening 762.

An adhesive may be injected into the club head 100 to capture and secure loose metal particles that are formed therein either as a result of manufacturing or wear incurred during use of the club. Securing the loose particles in this manner improves the acoustic appeal of the club head 100 by preventing the particles from rattling inside the club head 100 and producing an undesirable noise. A suitable adhesive may be any kind that remains tacky at room temperature, to allow for continued capturing of particles that might become loose over the life of the club; and may include hot-melt glue (e.g., such as that often used in glue-type rodent traps). The adhesive may also be used to add a slight weighting to the club head 100; in which instance the particular type of glue will be selected based on both its adhesive character and its weighting character.

With the weighting system 700, a screw port 750 and a weight screw 710 received therein extend in a direction perpendicular to the axis H of the club shaft 200, and an annular head 716 of the weight screw 710 is positioned substantially adjacent the axis H. In this manner, the received weight screw 710 will provide added weight to the club that enables adjustment of the swingweighting. At the same time however, because the weight screw 710 is positioned substantially adjacent the axis H of the club shaft 200, there is incurred only a minimal influence, if any, on the weighting characteristics of the club head 100 itself (e.g., center of gravity, MOI, etc.). In addition, with the inclusion of the opening 762 at the inner end of the bore 752, the weight system 700 provides a convenient port for injecting an adhesive into the club body which is also concealed and therefore avoids the appearance of any unsightly port or sealing plug on an outer surface of the club head 100. Thus, the weight system 700 allows for improvement of the acoustic appeal of the club head 100 without compromising the visual appeal thereof.

Examples

The following non-limiting examples are merely illustrative of the preferred embodiments of the present invention, and are not to be construed as limiting the invention, the scope of which is defined by the appended claims.

The following Table I sets forth exemplary dimensions for a golf club set according to one embodiment of the present invention, that includes a first, second and third club head (such as shown, generally, in FIGS. 1-2).

TABLE I

| | Dimension | Club Head 1 | Club Head 2 | Club Head 3 |
|---|---|---|---|---|
| α | Loft Angle (°) | 19 | 22 | 25 |
| β | Lie Angle (°) | 59 | 59.5 | 60 |
| L23 | Ground Point of Hosel Centerline to Part Centerline (mm) | 29 | 28.4 | 27.8 |
| L1 | Hosel Center Axis to Toe (mm) | 80.4 | 78.5 | 76.6 |
| L3 | Hosel Center Axis to Back Edge (mm) | 49.7 | 47.2 | 43.8 |
| Di | Hosel Bore Inner Diameter (mm) | 11.8 | 11.8 | 11.8 |
| L5 | Hosel length to ground plane (mm) | 45 | 44.8 | 44.6 |
| Do | Hosel outer diameter (mm) | 14 | 14 | 14 |
| L7 | Width (mm) | 65 | 63 | 60.7 |
| L25 | Face Progression (mm) | 15.2 | 16 | 16.9 |
| L9 | Crown-Peak Height (mm) | 34.2 | 33.3 | 32.6 |
| L11 | Bulge Radius (mm) | 254 | 254 | 254 |
| L13 | Roll Radius (mm) | 242 | 242 | 242 |
| V | Volume (including hosel, without sole geometery - cc) | 110 | 101 | 92 |
| L17 | Face Center from Ground (vertical mm) | 17.5 | 17.2 | 16.9 |
| L19 | Face Height at Center (bottom edge to top edge - mm) | 27.7 | 27.7 | 27.8 |
| L21 | Face Elevated Height at Center (vertical from ground to top edge - mm) | 30.5 | 29.9 | 29.3 |
| W | Finished Assembly, Total Weight (g) | 231.6 | 236.6 | 242.5 |

As can be seen from Table I, the three club heads have progressively increasing finished assembly total weights W. In particular, the progressively increasing total weights W allow each club head to confer a target balance to the individually assembled clubs, upon being matched with corresponding club shafts, to thereby provide each of the separately assembled clubs with a common swing weight.

Though the difference in total weight W between sequential club heads in a given set will vary depending on the change in length between the corresponding shafts, a difference in total weight W between each of the three clubs heads (in succession) is about 11 grams about 5 grams to about 7 grams. In addition, there is about 0.8 mm to about 0.9 mm increase in face progression across the sequential heads (L25 in Table I). Furthermore, there is a decrease in volume across the sequential heads of about 9 cc (V in Table I).

Although the present invention has been described with reference to particular embodiments, it will be understood to those skilled in the art that the disclosure herein is exemplary only and that the invention may include additional features, if desired, including features that are known and used in the art; and that various other alternatives, adaptations, and modifications may be made within the scope and spirit of the present invention.

For example, although the foregoing disclosure discusses progressive head sizes relative to three sequentially lofted hybrid club heads, those skilled in the art will appreciate that principles of the present invention are applicable to other types of clubs (e.g., metal-wood, iron, and other club heads), and are applicable to a series of more than three clubs (e.g., series of four or more clubs).

Also, although the foregoing examples of the weight system 600 discuss semispherical and semicylindrical cavities, those skilled in the art will appreciate that other shaped cavities may also be used in the weight system 600. For example, the weight system 600 may incorporate a semiconical cavity; a semi-prolate-spheroid; and the like. In addition, although the foregoing examples of the weight system 600 discuss formation of the weight bodies 610/640 on the sole of the club head, those skilled in the art will appreciate that the weight bodies 610/640 may also be formed on the crown, to achieve a different influence on the weighting of the club head.

Furthermore, although the foregoing examples of the weight system 700 discuss only a single set of a weight screw 710 and a screw port 750, those skilled in the art will appreciate that the weight system 700 may use two or more sets of a weight screw 710 and a screw port 750.

While the disclosed methods may be performed by executing all of the disclosed steps in the precise order disclosed, without any intermediate steps therebetween, those skilled in the art will appreciate that the methods may also be performed: with further steps interposed between the disclosed steps; with the disclosed steps performed in an order other than the exact order disclosed; with one or more disclosed steps performed simultaneously; and with one or more disclosed steps omitted.

To the extent necessary to understand or complete the disclosure of the present invention, all publications, patents, and patent applications mentioned herein are expressly incorporated by reference herein to the same extent as though each were individually so incorporated. In addition, ranges expressed in the disclosure are considered to include the endpoints of each range, all values in between the end points, and all intermediate ranges subsumed by the end points.

Accordingly, the present invention is not limited to the specific embodiments as illustrated herein, but is instead characterized by the appended claims.

What is claimed is:

1. A set of golf clubs comprising:

a first golf club comprising a first club head having a first loft angle, a first lie angle, and a first face height;

a second golf club comprising a second club head having a second loft angle, a second lie angle, and a second face height; and a third golf club comprising a third club head having a third loft angle, a third lie angle, and a third face height, wherein the first loft angle is less than the second loft angle, and wherein the third loft angle is greater than the second loft angle, wherein the third face height is less than the second face height, and wherein the second face height is less than the first face height, wherein each of the first, second, and third club heads comprise (i) a weight pad along the sole or (ii) a hosel access port located on a heel side of the sole configured to receive a weight screw, wherein the weight pad comprises a forward surface, a top surface, and a semispherical surface that extends through the weight pad to define a semispherical cavity that is open in the top surface, and wherein each weight screw for each of the first, second, and third golf club heads differs by about 2 grams or more.

2. The set of golf clubs of claim 1, wherein the first lie angle is less than the second lie angle, and wherein the second lie angle is less than the third lie angle.

3. The set of golf clubs of claim 1, wherein each club head has a hosel center axis and a toe edge, wherein each club head has a length from the hosel center axis to the toe-edge (L1), wherein L1 for the first club head is greater than L1 for the second club head, and wherein L1 for the third club head is less than L1 for the second club head, and L1 differs by about 1 mm to about 4 mm for each club head in the set.

4. The set of golf clubs of claim 1, wherein each club head has a hosel center axis and a back edge, wherein each club has a length from the hosel center axis to the back edge (L3), wherein L3 for the first club head is greater than L3 for the second club head, and wherein L3 for the third club head is less than L3 for the second club head.

5. The set of club heads of claim 4, wherein L3 differs by about 2 mm to about 5 mm for each club head in the set.

6. The set of golf clubs of claim 1, wherein each club head has a length from the hosel to ground plane (L5), wherein L5 for the first club head is greater than L5 for the second club head, and wherein L5 for the second club head is greater than L5 for the third club head.

7. The set of golf clubs of claim 1, wherein the first loft angle ranges from about 18° to about 20°, wherein the second loft angle ranges from about 21° to about 23°, and wherein the third loft angle ranges from about 24° to about 26°.

8. The set of golf clubs of claim 7, wherein the first lie angle ranges from about 58° to about 60°, wherein the second lie angle ranges from about 58.5° to about 60.5°, and wherein the third lie angle ranges from about 59° to about 61°.

9. The set of golf clubs of claim 1, wherein the first lie angle ranges from about 58° to about 60°, wherein the second lie angle ranges from about 58.5° to about 60.5°, and wherein the third lie angle ranges from about 59° to about 61°.

10. A set of golf clubs comprising:

a first golf club comprising a first club head having a first loft angle, a first lie angle, a first length from a hosel center axis to a toe edge, and a first face height;

a second golf club comprising a second club head having a second loft angle, a second lie angle, a second length from a hosel center axis to a toe edge, and a second face height; and a third golf club comprising a third club head having a third loft angle, a third lie angle, a third length from a hosel center axis to a toe edge and a third face height, wherein the first loft angle is less than the second loft angle, and wherein the third loft angle is greater than the second loft angle, wherein the first length is greater than the second length, and wherein the second length is greater than the third length, wherein the third face height is less than the second face height, and wherein the second face height is less than the first face height, wherein each of the first, second, and third club heads comprise (i) a weight pad along the sole, wherein the weight pad comprises a forward surface, a top surface, and a semispherical surface that extends through the weight pad to define a semispherical cavity that is open in the top surface, or (ii) a hosel access port located on a heel side of the sole configured to receive a weight screw, wherein the weight screw for the first golf club is formed from a first material, the weight screw for the second golf club is formed from a second material, and the weight screw for the third golf club is formed from a third material, and wherein at least two of the first, second, and third materials differ.

11. The set of golf clubs of claim 10, wherein the first club head has a fourth length from a hosel center axis and a back edge, the second club head has a fifth length from a hosel center axis and a back edge, and the third club head has a sixth length from a hosel center axis and a back edge, wherein the sixth length is less than the fifth length, and wherein the fifth length is less than the fourth length.

12. The set of club heads of claim 11, wherein the fourth, fifth, and sixth lengths differ from each other by at least about 2 mm.

13. The set of club heads of claim 10, wherein the first, second, and third lengths differ from each other by at least about 1 mm.

14. The set of club heads of claim 10, wherein each club head has a length from the hosel to ground plane (L5), wherein L5 for the first club head is greater than L5 for the second club head, and wherein L5 for the second club head is greater than L5 for the third club head.

15. The set of golf clubs of claim 10, wherein the first loft angle ranges from about 18° to about 20°, wherein the second loft angle ranges from about 21° to about 23°, and wherein the third loft angle ranges from about 24° to about 26°, and wherein the first lie angle ranges from about 58° to about 60°, wherein the second lie angle ranges from about 58.5° to about 60.5°, and wherein the third lie angle ranges from about 59° to about 61°.

16. A set of golf clubs comprising:

a first golf club comprising a first club head comprising a body defined by a crown, a sole, and a face and having a first loft angle, a first lie angle, and a first face height;

a second golf club comprising a second club head comprising a body defined by a crown, a sole, and a face and having a second loft angle, a second lie angle, and a second face height; and a third golf club comprising a third club head comprising a body defined by a crown, a sole, and a face and having a third loft angle, a third lie angle, and a third face height, wherein the first loft angle is less than the second loft angle, and wherein the third loft angle is greater than the second loft angle, wherein the third face height is less than the second face height, and wherein the second face height is less than the first face height, wherein at least one of the first, second, and third club heads comprise a weight pad along the sole, wherein the weight pad comprises a forward surface, a top surface, and a semispherical surface that extends through the weight pad to define a semispherical cavity that is open in the top surface, wherein the first loft angle ranges from about 18° to about 20°, wherein the second loft angle ranges from about 21° to about 23°, and wherein the third loft angle ranges from about 24° to about 26°, and wherein the first lie angle ranges from about 58° to about 60°, wherein the second lie angle ranges from about 58.5° to about 60.5°, and wherein the third lie angle ranges from about 59° to about 61°.

17. The set of golf clubs of claim 16, wherein each of the first, second, and third club heads comprise a weight pad along the sole.

18. The set of golf clubs of claim 16, wherein the top surface extends along a plane that is parallel to a neutral axis of the club head, and wherein the neutral axis is the axis that passes through a center of the face.

19. The set of golf clubs of claim 18, wherein the neutral axis is perpendicular to an outer surface of the face.

20. The set of golf clubs of claim 19, wherein each of the first, second, and third club heads comprise a weight pad along the sole.

21. The set of golf clubs of claim 16, wherein the semispherical surface is defined by a constant radius of curvature.

22. The set of golf clubs of claim 16, wherein the semispherical surface is defined by a non-constant radius of curvature.

23. A set of golf clubs comprising:

a first golf club comprising a first club head comprising a body defined by a crown, a sole, and a face and having a first loft angle, a first lie angle, and a first face height;

a second golf club comprising a second club head comprising a body defined by a crown, a sole, and a face and having a second loft angle, a second lie angle, and a second face height; and a third golf club comprising a third club head comprising a body defined by a crown, a sole, and a face and having a third loft angle, a third lie angle, and a third face height, wherein the first loft angle is less than the second loft angle, and wherein the third loft angle is greater than the second loft angle, wherein the third face height is less than the second face height, and wherein the second face height is less than the first face height, wherein each of the first, second, and third club heads comprise a weight pad along the sole and wherein the weight pad has a forward surface, a top surface, and a semispherical surface that extends through the weight pad to define a semispherical cavity that is open in the top surface, wherein the first loft angle ranges from about 18° to about 20°, wherein the second loft angle ranges from about 21° to about 23°, and wherein the third loft angle ranges from about 24° to about 26°, and wherein the first lie angle ranges from about 58° to about 60°, wherein the second lie angle ranges from about 58.5° to about 60.5°, and wherein the third lie angle ranges from about 59° to about 61°.

24. The set of golf clubs of claim 23, wherein the top surface extends along a plane that is parallel to a neutral axis of the club head.

25. The set of golf clubs of claim 23, wherein the neutral axis is the axis that passes through a center of the face, and wherein the neutral axis is perpendicular to an outer surface of the face.

26. The set of golf clubs of claim 23, wherein the semispherical surface is defined by a constant radius of curvature.

27. A set of golf clubs comprising:

a first golf club comprising a first club head having a crown, a sole, a first loft angle, a first lie angle, and a first face height;

a second golf club comprising a second club head having a crown, a sole, a second loft, a second lie angle, angle and a second face height; and a third golf club comprising a third club head having a crown, a sole, a third loft angle, a third lie angle, and a third face height, wherein the first loft angle is less than the second loft angle, and wherein the third loft angle is greater than the second loft angle, wherein the third face height is less than the second face height, and wherein the second face height is less than the first face height, wherein each of the first, second, and third club heads comprise a hosel access port located on a heel side of the sole configured to receive a weight screw, wherein each weight screw for each of the first, second, and third golf club heads differs by about 2 grams or more, wherein the first loft angle ranges from about 18° to about 20°, wherein the second loft angle ranges from about 21° to about 23°, and wherein the third loft angle ranges from about 24° to about 26°, and wherein the first lie angle ranges from about 58° to about 60°, wherein the second lie angle ranges from about 58.5° to about 60.5°, and wherein the third lie angle ranges from about 59° to about 61°.

28. The set of golf clubs of claim 27, wherein the hosel access port has a first axis and the weight screw has a second axis, and wherein the second axis is perpendicular to the first axis.

29. The set of golf clubs of claim 28, wherein the weight screw for the first golf club head comprises a first material, wherein the weight screw for the second golf club head comprises a second material, and wherein the weight screw for the third golf club comprises a third material, and wherein at least two of the first, second, and third materials differ from each other.

30. The set of golf clubs of claim 29, wherein the first, second, and third materials differ from each other.

* * * * *